US009921604B2

(12) United States Patent
Byun

(10) Patent No.: US 9,921,604 B2
(45) Date of Patent: Mar. 20, 2018

(54) ELECTRONIC ACCELERATOR PEDAL

(71) Applicant: KYUNG CHANG INDUSTRIAL CO., Ltd., Daegu (KR)

(72) Inventor: Sung-il Byun, Daegu (KR)

(73) Assignee: KYUNG CHANG INDUSTRIAL CO., LTD. (KR)

( * ) Notice: Subject to any disclaimer, the term of this patent is extended or adjusted under 35 U.S.C. 154(b) by 0 days.

(21) Appl. No.: 14/721,184

(22) Filed: May 26, 2015

(65) Prior Publication Data

US 2016/0342173 A1 Nov. 24, 2016

(30) Foreign Application Priority Data

May 21, 2015 (KR) ..... 10-2015-0070985

(51) Int. Cl.
*G05G 1/44* (2008.04)
*G05G 5/05* (2006.01)

(52) U.S. Cl.
CPC ..... *G05G 1/44* (2013.01); *G05G 5/05* (2013.01)

(58) Field of Classification Search
CPC ..... G05G 1/38; G05G 1/44; G05G 1/445; G05G 5/03; G05G 5/05; B60K 26/021; Y10T 74/20528; Y10T 74/20888; Y10T 74/20894; B60T 7/04
See application file for complete search history.

(56) References Cited

U.S. PATENT DOCUMENTS 6,523,433 B1 * 2/2003 Staker ..... G05G 1/30 74/513
7,278,337 B2 * 10/2007 Solta ..... B60K 26/02 74/513
7,296,494 B2 * 11/2007 Caba ..... B60K 26/02 74/513
7,404,342 B2 * 7/2008 Wurn ..... G05G 1/38 74/512
7,793,566 B2 * 9/2010 Ypma ..... G05G 1/38 74/513
8,161,842 B2 * 4/2012 Kim ..... B60K 26/021 74/513

(Continued)

FOREIGN PATENT DOCUMENTS

KR 20080008028 1/2008
WO WO 03068549 A1 * 8/2003 ..... B60K 26/021
WO WO 2007092175 A1 * 8/2007 ..... B60K 26/021

OTHER PUBLICATIONS

Corresponding Office Action issued by the KIPO dated Jul. 20, 2016.

*Primary Examiner* — Adam D Rogers
(74) *Attorney, Agent, or Firm* — The Belles Group, P.C.

(57) ABSTRACT

An electronic accelerator pedal may be provided that includes a pedal arm including a hinge; a spring, and a spring support beam A first end of the spring support beam is fixed to a fixing end of a housing and a second end of the spring support beam is provided with a friction member which contacts the hinge. When an external force is applied to the spring support beam, the spring support beam rotates about the fixing end of the housing within a predetermined range. At least one protrusion is formed on the first end of the spring support beam. A thickness of the at least one protrusion in a direction in which the elastic force is applied to the pedal arm by the spring is thinner than a thickness of the first end.

8 Claims, 5 Drawing Sheets

(56) References Cited

U.S. PATENT DOCUMENTS

| | | | | |
|---|---|---|---|---|
| 9,069,371 | B2 * | 6/2015 | Kim | G05G 5/03 |
| 9,110,494 | B2 * | 8/2015 | Kim | G05G 1/44 |
| 9,671,815 | B2 * | 6/2017 | Fuller | G05G 1/44 |
| 2003/0226419 | A1 * | 12/2003 | Yokochi | G05G 1/38 74/513 |
| 2012/0006149 | A1 * | 1/2012 | Galea | G05G 1/327 74/560 |
| 2015/0096407 | A1 * | 4/2015 | Fuller | G05G 1/44 74/513 |
| 2015/0277479 | A1 * | 10/2015 | Viethen | B60K 26/021 74/560 |

* cited by examiner

ELECTRONIC ACCELERATOR PEDAL

CROSS REFERENCE TO RELATED APPLICATIONS

Priority is claimed under 35 U.S.C. § 119 to Korean Patent Application No.: 10-2015-0070985, filed May 21, 2015, the disclosure of which is incorporated herein by reference in its entirety.

FIELD OF THE INVENTION

The present invention relates to an electronic accelerator pedal, and more particularly to an electronic accelerator pedal which is given hysteresis, thereby improving the operation feeling and relieving fatigue.

BACKGROUND OF THE INVENTION

An accelerator pedal accelerates the rotation of an engine. It is necessary to step on the accelerator pedal in order to accelerate by increasing the engine speed, and is necessary to release the foot from the accelerator pedal in order to decrease the engine speed. The accelerator pedal is connected to a throttle valve via the wire and linkage. Stepping on the accelerator pedal, the throttle valve is opened and air is inhaled into the cylinder. Then, the electronic control fuel injection device detects the amount of the air and supplies gasoline suitable for the operation state of the engine.

The accelerator pedal includes a mechanical accelerator pedal and an electronic accelerator pedal. In the mechanical accelerator pedal, the accelerator pedal is mechanically connected to the throttle valve of the engine by a cable. In the electronic accelerator pedal, the position of the pedal is sensed by a sensor and the operation of the throttle valve is controlled based on the sensed position signal.

The mechanical accelerator pedal causes problems in its operation due to ambient environments, temperature change, degradation of the cable, etc. Accordingly, at present time, the mechanical accelerator pedal has been replaced with the electronic accelerator pedal. Since the electronic accelerator pedal does not require the cable, it has a sufficient space for installation, reduces the fatigue of a driver and improves the fuel efficiency.

However, the driver has a preference for a tactile response that the driver feels from the conventional mechanical accelerator pedal. Also, hysteresis must be generated so as to relieve the driver's fatigue caused by the operation of the electronic accelerator pedal.

A method for generating the hysteresis which is applied to a conventional electronic accelerator pedal has a structure friction method, a housing friction method, etc. However, these methods have a complex structure and require a great number of parts.

SUMMARY OF THE INVENTION

One embodiment is an electronic accelerator pedal that includes: a pedal arm including a hinge rotatably connected to a housing; a spring which is fixed to the pedal arm and applies an elastic force to the pedal arm during the rotation of the hinge; a spring support beam which supports the spring, wherein one end of the spring support beam is fixed to the housing and the other end of the spring support beam is provided with a friction member which contacts the hinge.

When the spring contracts by the downward movement of the pedal arm and the rotation of the hinge, the other end of the spring support beam moves toward the hinge and then a friction force may be increased between the hinge and the friction member.

A friction surface of the friction member, which contacts with the hinge, may be flat or curved.

Hysteresis may be transformed by the curvature change of the friction surface.

The friction member may be connected to the other end of the spring support beam in an attachable and detachable manner.

The spring support beam may be comprised of a cantilever.

At least one protrusion may be formed on one end of the spring support beam and may be connected to a fixing end of the housing.

The other end of the spring support beam may extends in parallel with the longitudinal direction of the spring so that the spring support beam is an L-shaped support beam.

DETAILED DESCRIPTION OF THE INVENTION

Figure 1:
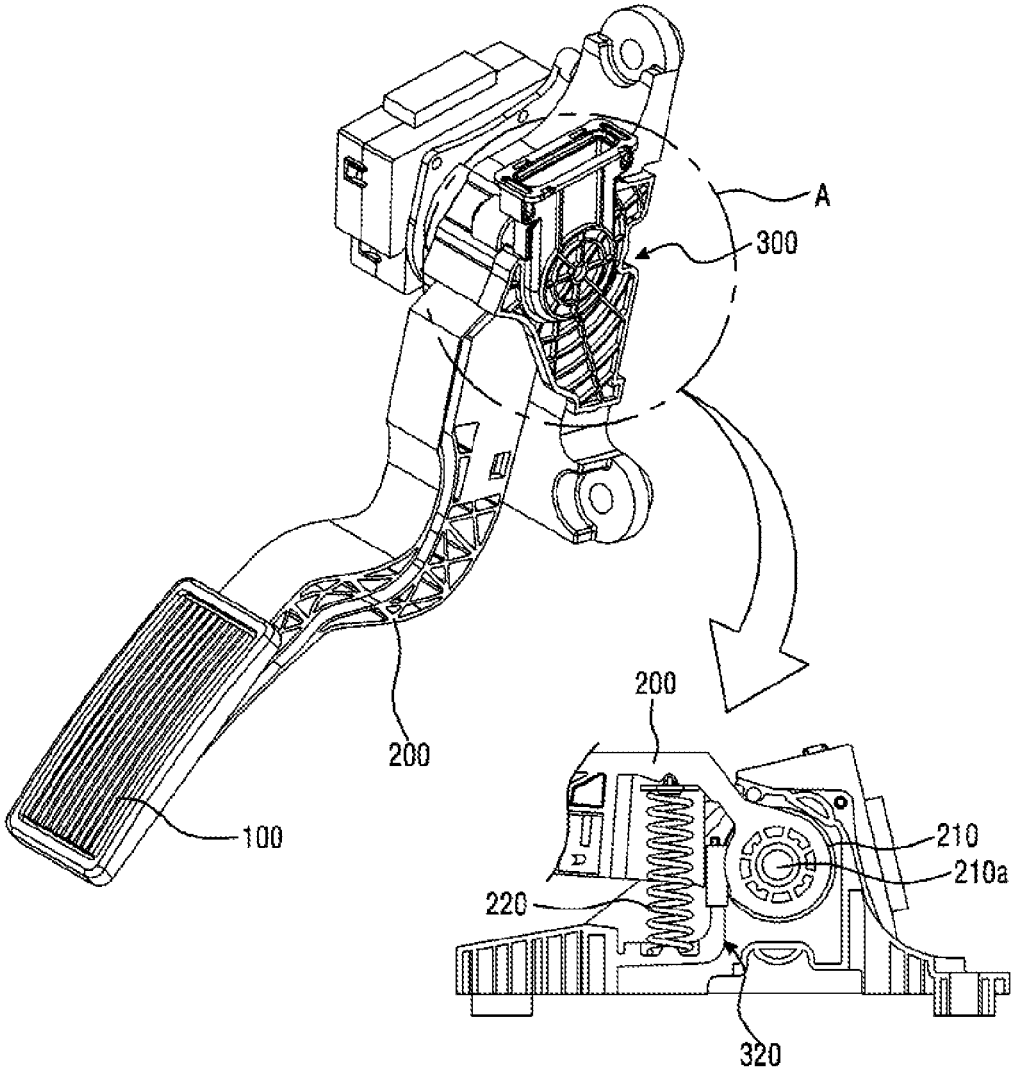
FIG. 1 is a perspective view of an electronic accelerator pedal and an enlarged view of main components in accordance with an embodiment of the present invention.

Specific embodiments of the present invention will be described in detail with reference to the accompanying drawings. The specific embodiments shown in the accompanying drawings will be described in enough detail that those skilled in the art are able to embody the present invention. Other embodiments other than the specific embodiments are mutually different, but do not have to be mutually exclusive. Additionally, it should be understood that the following detailed description is not intended to be limited.

The detailed descriptions of the specific embodiments shown in the accompanying drawings are intended to be read in connection with the accompanying drawings, which are to be considered part of the entire written description. Any reference to direction or orientation is merely intended for convenience of description and is not intended in any way to limit the scope of the present invention.

Specifically, relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation.

Terms such as "attached," "affixed," "connected," "coupled," "interconnected," and similar refer to a relationship wherein structures are attached, connected or fixed to one another either directly or indirectly through intervening structures, as well as both movable or rigid attachments or relationships, unless expressly described otherwise.

FIG. 1 is a perspective view of an electronic accelerator pedal and an enlarged view of main components in accordance with an embodiment of the present invention. As shown in FIG. 1, the electronic accelerator pedal includes a pedal pad 100, a pedal arm 200 and a housing 300. The housing 300 is connected to a hinge 210 formed on one end of the pedal arm 200 and receives a spring 220. When the pedal arm 200 moves downward, the spring 220 is contracted and applies an elastic force upward. Meanwhile, the spring 220 is supported by a spring support beam 320. The structure of the spring support beam 320 will be described in detail with reference to FIG. 2.

The electronic accelerator pedal of FIG. 1 is installed on a dashboard on the lower portion of a driver's seat. The pedal pad 100 transmits a pedal effort to the pedal arm 200, and then causes the pedal arm 200 to pivot about a hinge axis 210*a*. The pedal pad 100 has a flat shape allowing the driver to easily operate.

The spring 220 has a predetermined modulus of elasticity. When the driver applies the pedal effort to the pedal pad 100, the pedal arm 200 pivots and contracts the spring 220. The spring 220 may be received in the vicinity of an area where the pedal arm 200 and the housing 300 are connected to each other, that is, an area where the hinge 210 is located. Furthermore, the spring 220 is positioned under the pedal arm 200 so as to be contracted by the downward movement of the pedal arm 200. The top of the spring 220 may be fixed to one side of the pedal arm 200. Here, a separate member for fixing the spring 220 to one side of the pedal arm 200 may be further included.

When the driver steps on the pedal pad 100, the pedal effort is applied to the pedal arm 200 and the pedal arm 200 pivots about the hinge axis 210*a*, so that the spring 220 is contracted. Meanwhile, an electronic accelerator pedal position (APP) sensor (not shown) senses the rotation amount of the pedal arm 200 and generates an electrical signal, and then transmits the electrical signal to a throttle controller. The throttle controller operates an actuator on the basis of the electrical signal received from the sensor, so that the opening and closing of the throttle valve is controlled and combustion amount is controlled.

When the driver takes his/her foot off the pedal pad 100, the pedal arm 200 pivots in the reverse direction and returns to its initial position by the contracted spring 220.

Figure 2:
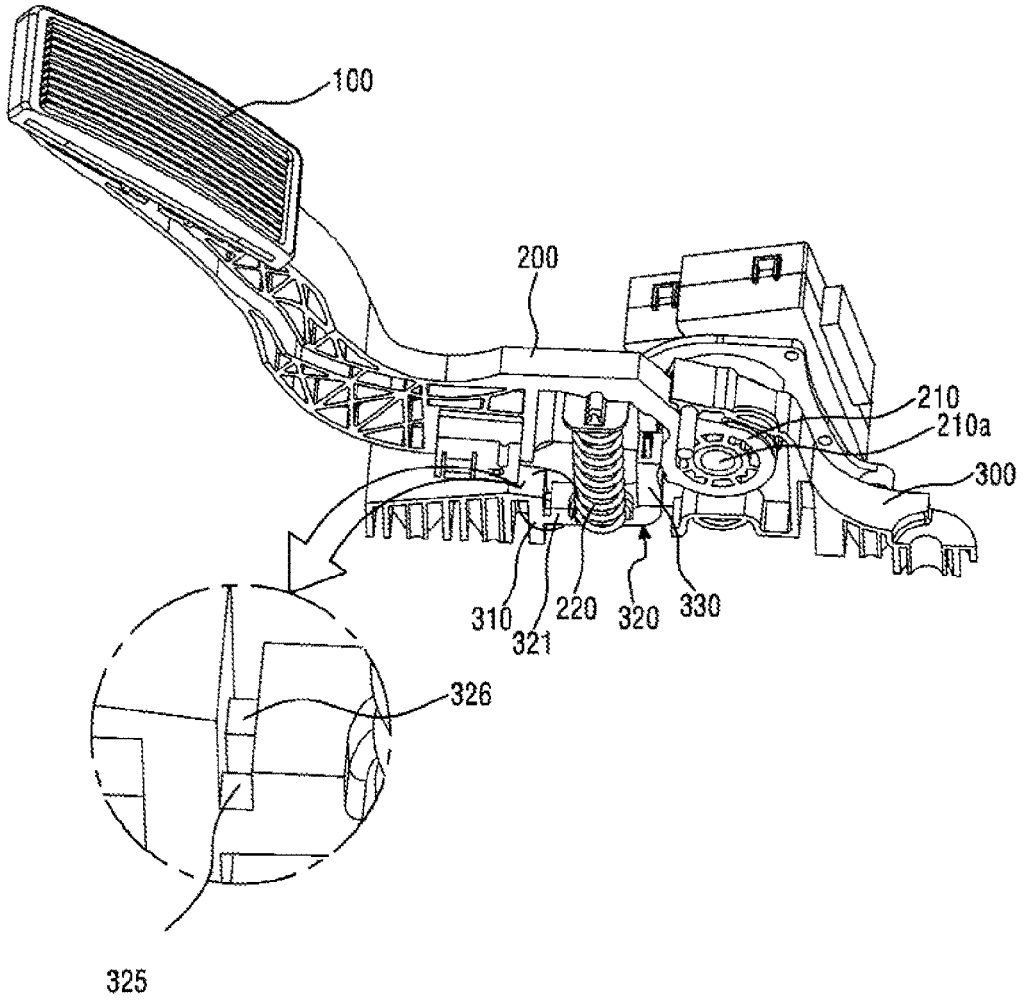
FIG. 2 is a sectional perspective view showing a configuration of the electronic accelerator pedal according to the embodiment of the present invention.

FIG. 2 is a sectional perspective view showing a configuration of the electronic accelerator pedal according to the embodiment of the present invention. The top of the spring 220 is fixed to the pedal arm 200 and the bottom of the spring 220 is supported by the spring support beam 320.

Meanwhile, the spring support beam 320 has a cantilever shape. More specifically, the spring support beam 320 is L-shaped. One end 321 of the spring support beam 320 is fixed to a fixing end 310 of the housing 300. FIG. 2 shows that two protrusions 325 and 326 are formed on one end of the spring support beam 320. The two protrusions 325 and 326 are connected to the fixing end 310 formed in the housing 300. When an external force is applied to the spring support beam 320, the spring support beam 320 may rotate about the fixing end 310 within a predetermined range. Here, the two protrusions 325 and 326 cause the spring support beam 320 not to be very tightly fixed to the fixing end 310, and thus, allow the spring support beam 320 to move within a predetermined range.

Furthermore, a thickness of at least one of the two protrusions 325 and 326 is thinner than a thickness of the one end 321 of the spring support beam 320. When the spring 220 applies an elastic force upward, the elastic force is applied to the pedal arm 200. The thickness of at least one of the two protrusions 325 and 326, in a direction in which the elastic force is applied to the pedal arm by the spring 220, is thinner than the thickness of the one end 321 of the spring support beam 320.

It is assumed in FIG. 2 that the two protrusions 325 and 326 are provided. However, there is no limit to this. A smaller or greater number of the protrusions may be provided. Also, when the spring support beam 320 has a cantilever shape, the spring support beam 320 is able to pivot to a certain extent. Therefore, it can be considered that the protrusion is not provided.

Meanwhile, the other end 322 of the spring support beam 320 extends in parallel with the spring 220. That is, the one end 321 of the spring support beam 320 extends perpendicularly to the longitudinal direction of the spring 220 and the other end 322 of the spring support beam 320 extends in parallel with the longitudinal direction of the spring 220. Accordingly, the spring support beam 320 is L-shaped.

A friction member 330 having a predetermined coefficient of friction is provided on the other end 322 of the spring support beam 320. The friction member 330 contacts the surface of the hinge 210. Although FIG. 2 shows that the contact surface of the friction member 330, which contacts the surface of the hinge 210, is a curved surface having an appropriate curvature, there is no limit to this. The contact surface of the friction member 330 may be flat. As will be described below, hysteresis may be generated according to the shape of the contact surface of the friction member 330.

Figure 3:
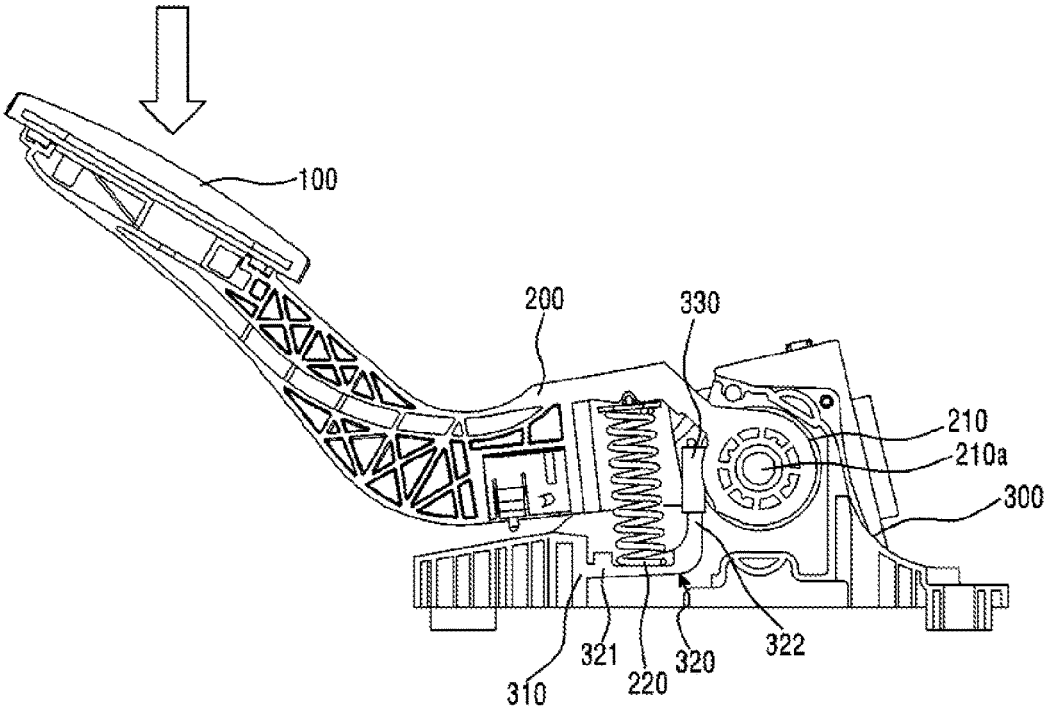
FIG. 3 is a view for describing the operation of the electronic accelerator pedal according to the embodiment of the present invention.
Figure 4:
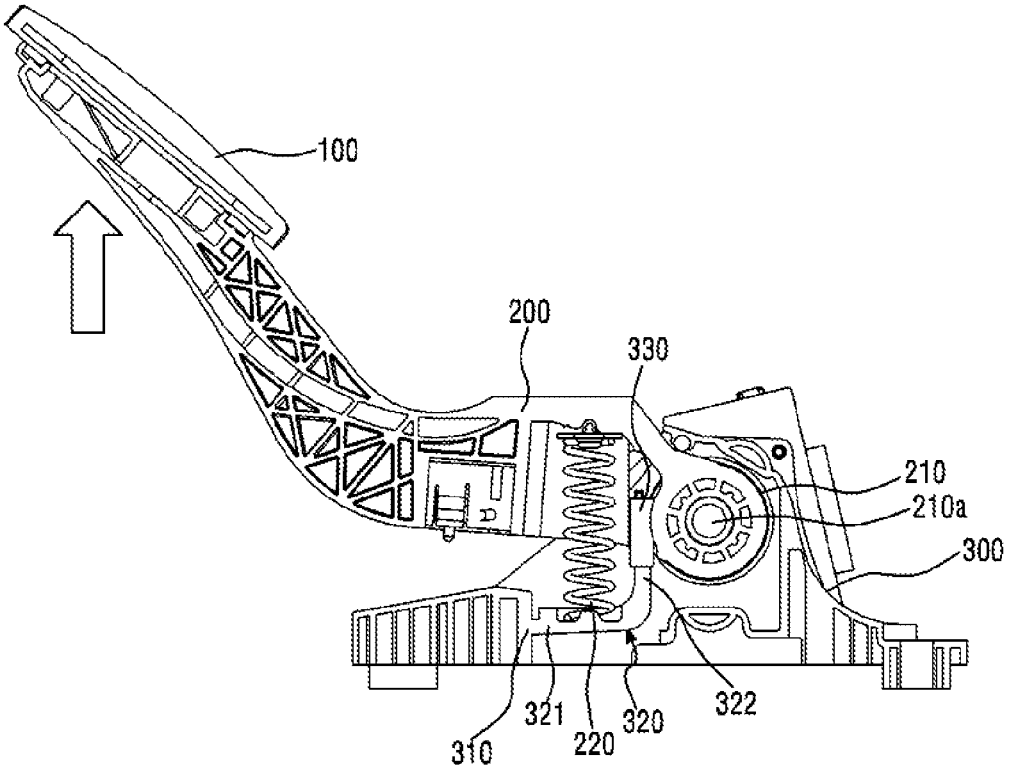
FIG. 4 is a view for describing the operation of the electronic accelerator pedal according to the embodiment of the present invention.

FIGS. 3 and 4 are views for describing the operation of the electronic accelerator pedal according to the embodiment of the present invention.

FIG. 3 shows that the driver has applied the pedal effort for acceleration. When the driver steps on the pedal pad 100, the pedal arm 200 pivots about the hinge axis 210*a* and the spring 220 is contracted. The pedal effort applied to the pedal arm 200 is transmitted to the spring 220, and then the spring 220 is contracted and pushes downward the spring support beam 320.

Here, since the one end 321 of the spring support beam 320 is fixed to the fixing end 310 of the housing 300, a portion of the spring support beam 320, which is not fixed to the fixing end 310, rotates about the fixing end 310 within a predetermined range. Particularly, the protrusions 325 and 326 formed on the one end 321 of the spring support beam 320 allow the fixing end 310 to move.

The other end 322 of the spring support beam 320 moves toward the hinge 210 by the force applied from the pedal arm 200 and the spring 220. Since the friction member 330 provided on the other end 322 of the spring support beam 320 contacts the surface of the hinge 210, the friction member 330 and the hinge 210 come in close contact with each other, so that a frictional force increases.

Eventually, the more the driver applies the pedal effort to the pedal pad 100, the more the frictional force between the friction member 330 and the hinge 210 increases. As a result, the hysteresis is generated.

FIG. 4 shows that the driver removes the pedal effort from the pedal pad 100. When the driver takes his/her foot off the pedal pad 100, the pedal arm 200 moves upward by the elastic force of the spring 220 and returns to its initial position. Also, the force which is applied to the spring support beam 320 is removed. Accordingly, the spring support beam 320 returns to its initial position with respect to the fixing end 310. As a result, the frictional force between the friction member 330 and the hinge 210 decreases.

According to this method, it is possible to generate the hysteresis only by a smaller number of the components (only the spring support beam 320 and the friction member 330 in the embodiment of the present invention) than that of a conventional apparatus for generating the hysteresis.

Figure 5:
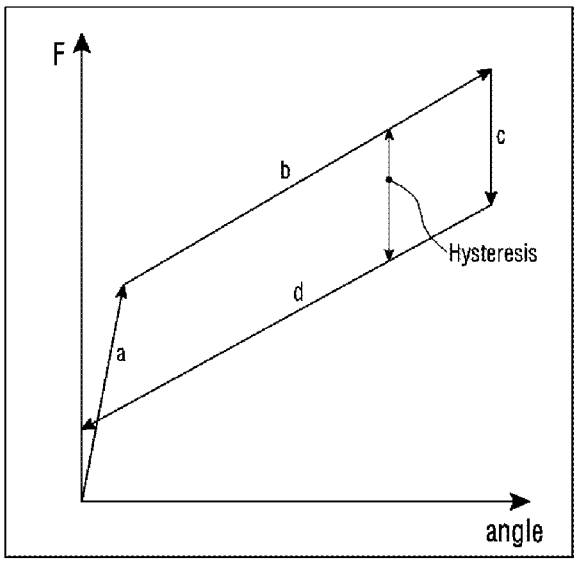
FIG. 5 is a graph showing hysteresis which is generated by the electronic accelerator pedal according to the embodiment of the present invention.

FIG. 5 is a graph showing hysteresis which is generated by the electronic accelerator pedal according to the embodiment of the present invention.

In FIG. 5, the vertical axis represents the pedal effort "F" required for pivoting the pedal arm 200. The horizontal axis represents a pedal pivot angle. A path "a" represents a pedal effort required for the driver to start to step on the pedal pad 100.

A path "b" shows that a pedal effort required for the driver to continuously move the pedal pad 100 increases. A path "c" shows that the pedal effort decreases before the driver takes his/her foot off the pedal pad 100. In the path "c" representing a non-moving of the pedal pad 100, the pedal effort by the driver decreases and continuously maintains the same pivot angle.

Lastly, a path "d" shows that the pedal returns to its initial position due to the decrease or removal of the pedal effort.

In the electronic accelerator pedal according to the embodiment of the present invention, the hysteresis shown in FIG. 5 is generated only by the spring support beam 320 and the friction member 330. Therefore, the electronic accelerator pedal has a simpler structure and requires a lower cost than the conventional apparatus for generating the hysteresis.

Figure 6:
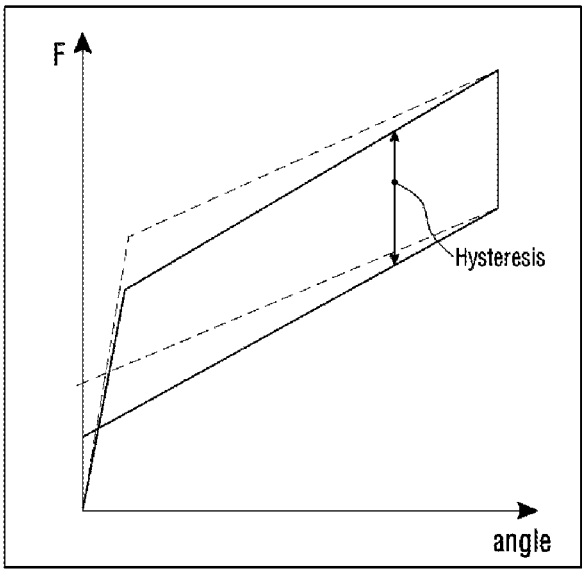
FIG. 6 is a graph showing that the hysteresis is transformed by changing the shape of a friction member of the electronic accelerator pedal according to the embodiment of the present invention.

FIG. 6 is a graph showing that the hysteresis is transformed by changing the shape of the friction member of the electronic accelerator pedal according to the embodiment of the present invention.

In FIG. 6, the vertical axis represents the pedal effort "F" required for pivoting the pedal arm 200. The horizontal axis represents a pedal pivot angle. FIGS. 2 to 4 show that the friction surface of the friction member 330 contacting the hinge 210 is a curved surface having an appropriate curvature.

However, when the friction surface of the friction member 330 contacting the hinge 210 is a curved surface having a predetermined curvature, the frictional force between the hinge 210 and the friction member 330 may be changed.

The friction member 330 may be provided on the other end 322 of the spring support beam 320 in an attachable and detachable manner. Therefore, the friction member 330 having another shape is attached to the spring support beam 320, so that hysteresis having another aspect can be generated.

Besides, the material of the friction member 330 is changed by using the above-mentioned principle, so that hysteresis having another aspect can be generated.

FIG. 6 shows that, when the friction member 330 has another shape or the material of the friction member 330 is changed, the aspect of the hysteresis is changed (from the solid line to the dotted line). As shown in FIG. 6, the pedal effort and pedal pivot angle may be changed at the time of moving from the path "a" to the path "b".

That is, according to the embodiment of the present invention, the aspect of the hysteresis is changed only by changing the shape or material of the friction member 330.

While the present invention has been described from the viewpoint of the specific embodiment including the exemplary embodiment of the present invention, it can be understood by those skilled in the art that various substitutions and modifications can be made in the above-described configuration of the present invention. Also, structural and functional changes can be variously made without departing from the scope and spirit of the present invention. Therefore, the scope and spirit of the present invention should be construed broadly as described in the claims of the present specification.

What is claimed is:

1. An electronic accelerator pedal comprising:

a pedal arm comprising a hinge rotatably connected to a housing;

a spring which is fixed to the pedal arm and applies an elastic force to the pedal arm during the rotation of the hinge; and a spring support beam which supports the spring;

wherein a first end of the spring support beam is fixed to a fixing end of the housing and a second end of the spring support beam is provided with a friction member which contacts the hinge;

wherein the spring is positioned under the pedal arm so as to be contracted by the downward movement of the pedal arm when the pedal arm is caused to pivot;

wherein the spring has a top directly fixed to the pedal arm and a bottom supported by the spring support beam;

wherein the spring support beam comprises a horizontal portion corresponding to the first end thereof and a vertical portion corresponding to the second end so that the spring support beam is an L-shaped support beam, the horizontal portion extending perpendicularly to a longitudinal direction of the spring and the vertical portion extending parallel with the longitudinal direction of the spring;

wherein at least one protrusion is formed on the first end of the spring support beam and is connected to the fixing end of the housing;

wherein a thickness of the at least one protrusion in a direction in which the elastic force is applied to the pedal arm by the spring is thinner than a thickness of the first end;

wherein when a pedal effort applied to the pedal arm is transmitted to the spring, the spring is contracted and pushes downward the spring support beam; and wherein when an external force is applied to the spring support beam, the spring support beam rotates about the fixing end of the housing within a predetermined range.

2. The electronic accelerator pedal of claim 1, wherein, when the spring contracts according to the rotation of the pedal arm, the second end of the spring support beam moves toward the hinge and then a friction force is increased between the hinge and the friction member.

3. The electronic accelerator pedal of claim 1, wherein a friction surface of the friction member, which contacts the hinge, is curved.

4. The electronic accelerator pedal of claim 3, wherein hysteresis is transformed by a curvature change of the friction surface.

5. The electronic accelerator pedal of claim 1, wherein the friction member is connected to the second end of the spring support beam in an attachable and detachable manner.

6. The electronic accelerator pedal of claim 1, wherein the spring support beam has a cantilever shape.

7. The electronic accelerator pedal of claim 1, wherein the spring support beam supports the spring between the first end of the spring support beam and the second end of the spring support beam.

8. The electronic accelerator pedal of claim 1, wherein the spring support beam supports the spring at the horizontal portion.

* * * * *